United States Patent [19]

Nishimiya et al.

[11] 4,231,340

[45] Nov. 4, 1980

[54] EXHAUST GAS RECIRCULATION CONTROL SYSTEM FOR INTERNAL COMBUSTION ENGINE

[75] Inventors: Torazo Nishimiya, Mito; Masamitsu Okumura, Katsuta; Tomo Ito, Katsuta; Seisaku Numakura, Katsuta, all of Japan

[73] Assignee: Hitachi, Ltd., Japan

[21] Appl. No.: 50,451

[22] Filed: Jun. 20, 1979

[30] Foreign Application Priority Data

Jun. 20, 1978 [JP] Japan ..... 53-74664

[51] Int. Cl.[3] ..... F02M 25/06

[52] U.S. Cl. ..... 123/568

[58] Field of Search ..... 123/119 A

[56] References Cited

U.S. PATENT DOCUMENTS

| | | | |
|---|---|---|---|
| 3,814,070 | 6/1974 | Wertheimer | 123/119 A |
| 3,896,777 | 7/1975 | Masaki et al. | 123/119 A |
| 3,931,813 | 1/1976 | Horie et al. | 123/119 A |
| 4,041,917 | 8/1977 | Suzuki | 123/119 A |
| 4,114,577 | 9/1978 | Aoyama | 123/119 A |
| 4,137,874 | 2/1979 | Otsubo et al. | 123/119 A |
| 4,173,204 | 11/1979 | Takayama | 123/119 A |
| 4,185,607 | 1/1980 | Thornburgh | 123/119 A |
| 4,186,702 | 2/1980 | Day et al. | 123/119 A |

*Primary Examiner*—Wendell E. Burns
*Attorney, Agent, or Firm*—Craig & Antonelli

[57] ABSTRACT

An exhaust gas recirculation control system for controlling the amount of exhaust gas subjected to recirculation to the air inlet depending on the amount of inlet air of an internal combustion engine. This system comprises a control valve disposed in an exhaust gas recirculation passage, for controlling the amount of exhaust gas recirculation, an orifice disposed in the recirculation passage, for creating a negative pressure upstream of the control valve, and a solenoid valve for generating a pressure which controls the control valve. The solenoid valve comprises a core formed therein with a hollow passage opened at one end to a valve portion, a plunger made of a magnetic material and having a valve seat opposing the open end to define the valve portion, a spring biasing the plunger in the opening direction of the valve portion, a first exciting coil generating, when passing therethrough a current proportional to the amount of inlet air, a force acting on the plunger to close the valve portion, and a second exciting coil generating, when passing therethrough a current in inverse proportion to the pressure downstream of the orifice, a force opposite to the force on the plunger due to the first exciting coil.

8 Claims, 1 Drawing Figure

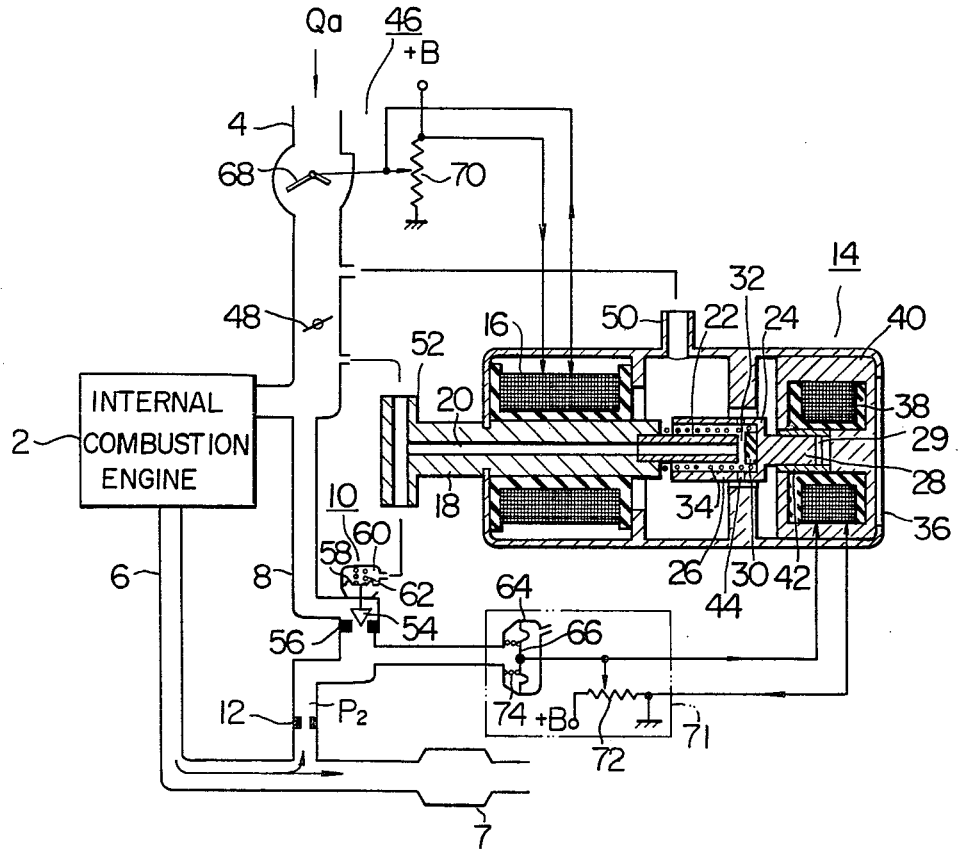
Qa
46
+B
4
68
70
14
32
48
16
50
22
24
40
52
INTERNAL
COMBUSTION
ENGINE
2
20
38
29
28
10
18
34
36
60
58
6
8
62
64
26
30
42
44
56
54
66
12
P2
74
+B
72
71
7

EXHAUST GAS RECIRCULATION CONTROL SYSTEM FOR INTERNAL COMBUSTION ENGINE

BACKGROUND OF THE INVENTION

1. Field of the Invention

The present invention relates to an exhaust gas recirculation control system for an internal combustion engine for use in automobiles or the like and more particularly, to the system being capable of obtaining the amount of exhaust gas recirculation which accurately depends on the amount of inlet air.

2. Description of the Prior Art

Generally, in order to decrease the amount of nitrogen oxides in exhaust gas from automobiles, there is available a well known effective measure in which the exhaust gas is partly subjected to recirculation into the inlet channel to thereby lower the maximum temperature at the time of combustion. Since the exhaust gas recirculation is, however, carried out at the cost of low operational efficiency and degradation in fuel comsuption rate, it is necessary to adjust and attain an optimum exhaust gas recirculation rate (hereinafter referred to as EGR rate) which meets operational conditions.

An approach is made today to a control system wherein a Venturi negative pressure in the carburetor is detected to obtain an optimum EGR rate in accordance with the amount of inlet air. In this respect, one may refer to Japanese Patent Application Laid-Open No. 4423/75 issued on Jan. 17, 1975. According to this Japanese Patent Application, while make-and-break of an exhaust gas recirculation control valve (hereinafter termed EGR control valve) is controlled in accordance with Venturi negative pressure and engine speed, the operation of the EGR control valve is feedback-controlled by monitoring the amount of exhaust gas recirculation per se.

According to another approach such as Japanese Patent Application Laid-Open No. 77924/77 issued on June 30, 1977, an orifice is arranged in an exhaust gas recirculation passage to generate a negative pressure in proportion to the amount of exhasut gas recirculation and this negative pressure is applied to a valve mechanism which generates a pressure signal for feedback controlling an EGR control valve. The valve mechanism generating the controlling pressure uses a diaphragm mounted in a chamber to which the negative pressure in the exhaust gas recirculation passage is introduced. The diaphragm used in such a valve mechanism is usually made from a rubber sheet and chemically sensitive to $SO_2$ and ozone contained in the exhaust gas, being liable to change its state. In addition, due to frequent repetition of vibratory deformations during the operation of automobile, this diaphragm gradually becomes worn, giving rise to its inaccurate operation and degradation in its controlling accuracy. This leads to necessity of exchanging the valve mechanism which can be accomplished only with high skill and at a high cost.

SUMMARY OF THE INVENTION

An object of the present invention is to provide a durable system for controlling the exhaust gas recirculation with high accuracy.

Another object of the present invention is to provide an exhaust gas recirculation control system which can incorporate a valve mechanism without a diaphragm by incorporating a solenoid valve into means for generating a controlling pressure which controls an EGR control valve.

BRIEF DESCRIPTION OF THE DRAWINGS

The signal FIGURE is a schematic diagram to show an overall construction of an exhaust gas recirculation control system of an internal combustion engine embodying the present invention.

DESCRIPTION OF THE PREFERRED EMBODIMENTS

With reference to the FIGURE of the accompanying drawing, an internal combustion engine 2 takes in air via an inlet pipe 4 and vents an exhaust gas via an exhaust pipe 6 and a catalyzer pipe 7. The exhaust gas in the exhaust pipe 6 is partly subjected to recirculation into an intake manifold of the inlet pipe 4 via an exhaust gas recirculation pipe 8. Within the exhaust gas recirculation pipe 8 is disposed an exhaust gas recirculation control valve 10 which controls the amount of exhaust gas recirculation. Upstream of the exhaust gas recirculation control valve 10, there is provided an orifice 12 adapted to produce a negative pressure $P_2$ which depends on the amount of recirculation.

A solenoid valve generally designated at reference numeral 14 comprises a first exciting coil 16 and a core 18 associated therewith which is made of a magnetic material and is formed therein with a hollow passage 20 acting as an air flow path. Secured to one end, the right-hand end in the FIGURE, of the core 18 is a slender pipe 22 having a hollow passage in communication with the hollow passage 20. The righthand end of the pipe 22 is open. A plunger 24 made of a magnetic material has a cup portion 26 into which the pipe 22 is inserted and a rear projecting portion 28 contiguous to the cup portion 26. Mounted to end of the projecting portion 28 is a dumper rubber plate 29. At the bottom of the cup portion 26 is secured a valve seat 30 which opposes the open end of the pipe 22, whereby a valve portion 32 is constituted by the open end and the valve seat 30. A compression spring 34 surrounds the outer peripheral wall of the pipe 22 and biases the valve portion 32 to normally keep it opened. The solenoid valve 14 also comprises an airtight housing 36 made of a magnetic material and adapted to support therein the core 18 and an E-shaped core 40 associated with a second exciting coil 38. The projecting portion 28 of the plunger 24 is slidably supported in a sleeve 42 made of a non-magnetic material which in turn is secured to the core 40. A space within the sleeve is in communication with the external atmosphere via a suitable air outlet passage. In the wall of the cup portion 26 of the plunger 24 are formed an air flow opening or openings for reducing the air flow resistance. Sensitivity of the plunger 24 to magnetic action due to the first exciting coil can be promoted by the provision of the cup portion 26.

The inlet pipe 4 is provided with an air flow meter 46 and a throttle valve 48 and its intermediate passage between the air flow meter 46 and the throttle valve 48 is in communication with an outlet pipe 50 opened to the interior of the housing 36. An inlet passage downstream of the throttle valve 48 is in communication with the hollow passage 20 in the core 18 via a tube 52. The intermediate passage upstream of the throttle valve 48 is at a pressure substantially equal to external atmospheric pressure so that it may otherwise be opened to the external atmosphere. In place of providing the housing 36 with the outlet pipe 50, the housing 36 may mereby be formed with an opening.

The EGR control valve 10 has a valve body 54 and a valve seat 56, the valve body 54 being secured to a diaphragm 58 which is driven differentially. A chamber below the diaphragm is opened to external atmosphere while a chamber above the diaphragm, i.e., a negative pressure addmissive chamber 60 is in communication with the hollow passage 20 via the tube 52. The valve 10 is switched in response to the magnitude of the negative pressure in the hollow passage. The diaphragm 58 is balanced in an average equilibrium between a differential pressure and a bias of a compression spring 62.

Pressure $P_2$ taking place in the exhaust gas recirculation passage between the orifice 12 and the EGR control valve 10 is admitted to one chamber of a container 64 with a diaphragm 66. The other chamber is opened to the external atmosphere.

The air flow meter 46 comprises a measuring plate in the shape of a "L" character and a potentiometer 70. The measuring plate 68 increases its rotation angle in proportion to an amount $Q_a$ of inlet air, which is proportionally followed by the movement of a sleder of the potentiometer 70 to increase an output voltage therefrom. This output voltage is applied to the first exciting coil 16 to pass therethrough a current in proportion to the amount $Q_a$ of inlet air. A magnetomotive force due to the current flow in the first exciting coil acts to attract the plunger 24 in opposition to the force of the spring 34, thereby closing the valving portion 32. In place of the air flow meter, a Venturi tube may be provided which delivers a negative pressure to be detected as an equivalent to the amount of inlet air.

The second exciting coil 38 is connected to a pressure-electricity transducer 71 which responds to pressure $P_2$ in the exhaust gas recirculation pipe 8. The pressure-electricity transducer 71 comprises, for example, a potentiometer 72 with a slider secured to the diaphragm 66 which moves to the right or left in response to pressure $P_2$. This diaphragm is balanced with a differential pressure at the normal operation by means of a compression spring 74. The potentiometer 72 delivers an output which is proportional to the magnitude of pressure $P_2$ in the recirculation passage, i.e., the amount of exhaust gas recirculation. A magnetomotive force due to the second exciting coil cooperates with the action of the compression spring 34 to forcibly bring the plunger 24 into the opening action in opposition to the closing action of the plunger 24 due to the attraction force which the first exciting coil inparts to the plunger 24.

As being exposed to exhaust gas atmosphere, the diaphragm 66 is preferably made of a material which is chemically insensitive to sulphor oxides and ozone contained in the exhaust gas. A metal bellows may be substituted for the diaphragm 66. A strain guage or a differential transformer may be substituted for the potentiometer 72.

The operation of the exhaust gas recirculation control system will be described below.

When the throttle valve 48 is operated to open by an automobile driver, the amount of inlet air $Q_a$ increases to increase the current flow in the first exciting coil 16 with a resulting decrease in the spacing of the valve portion 32. At this time, a negative pressure is created downstream of the throttle valve 48 and it decreases the pressure in the hollow passage 20 which is in communication with the negative pressure and the pressure in the negative pressure admissive chamber 60 of the EGR control valve 10. Accordingly, the control valve 10 opens greatly to increase the amount of exhaust gas recirculation. As a result, pressure $P_2$ downstream of the orifice 12 is decreased to shift the diaphragm 66 to the left so that the output of the potentiometer 72 increases with the current flows in the second exciting coil 38 increased. Thus, a magnetomotive force due to this current acts to increase the spacing of the valve portion 32, and the pressure in the hollows passage 20 is increased to approximate the pressure upstream of the throttle valve 48 which is substantially equal to external atmospheric pressure, thereby increasing the pressure in the negative pressure admissive chamber 60. This in turn decreases the amount of exhaust gas recirculation, increases pressure $P_2$, and decreases the current flow in the second exciting coil. Eventually, the valve portion 32 is again forced to close. Continuous repetitions of the above operation cause the plunger 24 to vibrate to the right or left and in synchronism with the period of this vibration, the valve body 54 of the EGR control valve 10 is also caused to vibrate for its make-and-break.

The current flow in the first exciting coil 16 is proportional to the amount of inlet air $Q_a$. For conditioning closure of the valve portion 32 by this current, it is necessary for this current to exceed a certain value. Accordingly, when the amount of inlet air $Q_a$ exceeds a corresponding value, the EGR control valve 10 opens to initiate the exhaust gas recirculation. Since the more the amount of inlet air $Q_a$ increases, the larger the current in the first exciting coil 16 becomes so that the attraction force for closing action of the plunger 24 increases, there occurs an increase in the current flow in the second exciting coil 38 which permits recovery of opening action of the plunger 24 in opposition to the attraction force. The current flow in the second exciting coil 38 is in proportion to the amount of exhaust gas recirculation and eventually, the amount of exhaust gas recirculation is rendered proportional to the amount of inlet air $Q_a$.

In some applications, it is undesirable to make the exhaust gas recirculation proportional to inlet air. For example, when an automobile is accelerating, running on an ascent or running on a high way, the engine requires a high rate of power and it follows that the exhaust gas recirculation is required to be suppressed to increase combustion efficiency in the engine. With this in mind, the attraction force for the plunger 24 due to the current flow in the second exciting coil 38 is made about twice as large as the attraction force for the plunger 24 due to the current flow in the first exciting coil 16, within a range where the amount of inlet air $Q_a$ is large. This arrangement can be accomplished by making the resistance distribution of the potentiometer 72 exponential or by shunting in part the potentiometer 72 with a resistor. Thus, when the exhaust gas recirculation exceeds the certain value, the solenoid valve 14 is opened so that even with the amount of inlet air $Q_a$ exceeding the certain value, the amount of exhaust gas recirculation is fixed to a substantially constant value which it cannot exceed. In this manner, during particular operations requiring a high rate of power, the combustion efficiency in the engine can be increased so as to increase the engine output power.

As described above, according to the exhaust gas recirculation control system of the present invention, an accurate, predetermined relation can be maintained between the amounts of inlet air and exhaust gas recirculation. Accordingly, it is possible to make control for deriving an optimum EGR rate from the relation between rotation speed and load of the engine by controlling the duty factor of an electrical quantity delivered from the air flow meter 46. More particularly, EGR rates meeting rotation speed and load of the engine are previously stored in a memory, an optimum EGR rate most adaptive to the operational condition of automobile changing every moment is read out of the memory. Then, in accordance with the thus read out EGR rate, the duty factor of current being supplied to the first exciting coil 16 is controlled to ensure the operation of automobile under the optimum EGR rate.

The invention has been described by way of the exemplary pressure-electricity transducer 71 incorporating the diaphragm 66. In the event of failure of this diaphragm, its exchange can be conducted in easier and cheaper manner than exchange of the solenoid valve.

Further, the exhaust gas recirculation control system according to the invention can operate in good order without relying on the generation of Venturi negative pressure in the inlet pipe and therefore, can advantageously be applied to an operation control system for use with an internal combustion engine with an electronic control fuel injection apparatus.

We claim:

1. An exhaust gas recirculation control system of an internal combustion engine comprising:

a core formed therein with a hollow passage opened at its end;

a plunger made of a magnetic material and being movable in the axial direction of said core, said plunger having a valve seat opposing the open end of said core;

a spring biasing said plunger to bring a valve portion comprised of said open end and said valve seat into an open state;

a first exciting coil applying a force to said plunger to move said plunger in the closing direction in opposition to the bias of said spring;

a second exciting coil applying to said plunger a force substantially opposite to the force which said first exciting coil applies to said plunger;

a housing defining a chamber which incorporates said valve portion;

at least one opening formed in said housing and being in communication with a portion at a pressure substantially equal to external atmospheric pressure;

a flow-electricity transducer generating an electric signal depending on the amount of inlet air of the internal combustion engine and applying said electric signal to said first exciting coil;

means for communicating the hollow passage of said core to the downstream of a throttle valve;

an exhaust gas recirculation passage passing recirculation of partial exhaust gas of the internal combustion engine into a mixture introduced into said internal combustion engine;

a control valve disposed in said exhaust gas recirculation passage, for controlling the amount of exhaust gas recirculation in response to a negative pressure in the hollow passage of said core;

an orifice disposed in said exhaust gas recirculation passage, for generating a negative pressure at the upstream of said control valve; and a pressure-electricity transducer generating an electric signal in inverse proportion to the pressure downstream of said orifice and applying said electric signal to said second exciting coil.

2. An exhaust gas recirculation control system according to claim 1 wherein said plunger comprises a cup portion receiving the hollow passage open end of said core and having the valve seat at the bottom, and a projecting portion arranged behind said cup portion and inserted in said second exciting coil.

3. An exhaust gas recirculation control system according to claim 1 which comprises means for forcibly bringing said valve portion into an open state by exciting said second exciting coil even when the exciting current in said first exciting coil acts to close said valve portion.

4. An exhaust gas recirculation control system according to claim 1 wherein the force which said first exciting coil acts on said plunger is made sufficiently larger than the force which said second exciting coil acts on said plunger to forcibly open said valve portion at a pressure at the of said orifice which corresponds to an amount of exhaust gas recirculation to be restricted, whereby increase of the exhaust gas recirculation is restricted.

5. An exhaust gas recirculation control system according to claim 1 wherein said opening is in communication with the upstream of the throttle valve.

6. An exhaust gas recirculation control system according to claim 1 wherein said opening is opened to the external atmosphere.

7. An exhaust gas recirculation control system according to claim 1 wherein said flow-electricity transducer comprises a member rotatable depending on the amount of inlet air, and a potentiometer changing the voltage division ratio in accordance with the rotation of said member.

8. An exhaust gas recirculation control system according to claim 1 wherein said flow-electricity transducer generates an electric signal depending on a negative pressure created in a Venturi tube.

* * * * *